United States Patent [19]

Hansen

[11] 4,418,247

[45] Nov. 29, 1983

[54] ELECTRODYNAMIC TRANSDUCER

[75] Inventor: Kaj B. Hansen, Horsens, Denmark

[73] Assignee: International Standard Electric Corporation, New York, N.Y.

[21] Appl. No.: 265,717

[22] Filed: May 20, 1981

[30] Foreign Application Priority Data

May 23, 1980 [DK] Denmark ..... 2264/80

[51] Int. Cl.[3] ..... H04R 1/02; H04R 1/22; H04R 9/04

[52] U.S. Cl. ..... 179/115.5 R; 29/594; 179/115.5 VC

[58] Field of Search ..... 179/115.5 R, 115, 181, 179/115.5 VC; 29/594

[56] References Cited

U.S. PATENT DOCUMENTS 2,094,043 9/1937 Marshall ..... 29/84
3,342,953 9/1967 Pless ..... 179/115.5 R

FOREIGN PATENT DOCUMENTS 2322475 11/1974 Fed. Rep. of Germany .
2189972 1/1974 France .

*Primary Examiner*—Stafford D. Schreyer
*Attorney, Agent, or Firm*—John T. O'Halloran; Peter R. Ruzek

[57] ABSTRACT

In the method of making an electrodynamic transducer, the magnet part and the coil-diaphragm part are made in separate steps and are then assembled. The coil-diaphragm part is made in a plurality of successive stations; first a plane diaphragm material is adhered to one side of the carrier ring (10), and then a heat activatable glue is applied to the diaphragm in the region where the coil (15) is to be attached, and finally the diaphragm is formed with a heat emitting tool simultaneously with the coil (15) being pressed against the heat activated glue.

The transducer has a diaphragm (13) connected to a coil (15) which is moveable in a slit (6) between the pole shoes (3, 4) of a magnet (5), the pole shoes (3, 4) being fitted coaxially on a guide pin (2). To provide for exact centering of the coil (15) in the slit (6), a carrier ring (10), to which the diaphragm (13) is secured so that the coil (15) is concentric with the carrier ring (10), engages an outwardly facing, annular face (12) of the outermost pole shoe (3).

2 Claims, 13 Drawing Figures

Figure 1B:
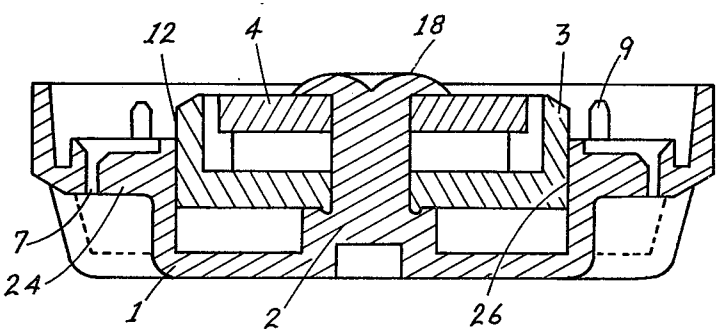

AA
BB
CC
C
C
13
20
15
6
34
17
9
14
10
27
12
1
11
8
3
7
24
8
19
9
17
20
A
A
B
B
65°

ELECTRODYNAMIC TRANSDUCER

The invention relates to a method of making an electrodynamic transducer of the type defined in the introductory portion of claim 1.

Such a transducer converts sound waves into electric signals or vice versa and thus serves as a microphone or as a loudspeaker, respectively. The present transducer is intended for use especially in the telephone engineering field. It is therefore essential that it has great sensitivity and that it can be mass produced at low costs. The use of a magnet material of higher remanence and thus greater content of energy than the ferrite magnets previously used permits the magnet volume to be reduced so much as will compensate for the more expensive material, viz. the rare earths and cobalt compounds, the so-called ReCo-magnets, and nevertheless provide greater sensitivity than ferrite magnets.

The object of the invention is to provide an electrodynamic transducer of the type described above which has an additionally improved sensitivity and can be produced almost completely automatically.

This is achieved according to the invention in that the method of making an electrodynamic transducer as described above is characterized by the features defined in the characterizing portion of claim 1. In previously known transducers the diaphragms are always preshaped before assembling the transducer. Moreover most previously known transducers were assembled from a large number of parts involving a series of critical tolerances. This made manufacturing of such transducers very difficult resulting in an non-acceptable high number of unacceptably high number of unsatisfactory assemblies. Furthermore, in all known transducers the preshaped diaphragm is only clamped to a carrier ring or the like, but such procedure is not possbile with the small size transducer of the present invention because of the risk of eccentricity.

The improved sensitivity is achieved because this structure provides a very precise centering of the coil in the annular slit which can therefore be made very narrow so that the losses in the magnet circuit will be relatively small and the sensitivity great. The precise centering of the coil in the annular slit is obtained in that the diaphragm is fixed to the carrier ring before forming the diaphragm and fixing the coil to the diaphragm, and that the carrier ring, which is connected to the coil via the diaphragm, is automatically centered very precisely with respect to the slit between the pole shoes by the engagement of the inwardly facing, cylindrical face of the carrier ring with the outwardly facing, cylindrical face of the outer pole shoe.

In the previously known electrodynamic transducers it was necessary to pass the ends or supply lines of the coil out through apertures or holes in a surrounding casing. Such process does not easily lend itself to an automatic production line.

A feature of the method according to the present invention is that in a step prior to the third station for making the coil-diaphragm part, the coil fitted on the guide templet is terminated by connecting the coil leads to coil terminals also being fitted to the guide templet, whereupon in the third station the coil terminals are secured to the carrier ring by pressing their ends into apertures in the carrier ring.

A further feature by which the process may be further automated is that the connection between the coil leads and the coil terminals is facilitated by fitting the coil terminans to a displacable part of the guide templet, which part may be temporarily displaced to allow dip soldering of the connection prior to securing the terminals to the carrier ring in the third station.

There is obtained a simplified mounting of the coil supply lines which are merely to be fitted into grooves in the carrier ring. These grooves may then be suitably closed over the coil supply lines, e.g. in that casing part surrounding the magnet system has projections opposite the grooves.

A desired frequency characteristic can be provided in an electrodynamic transducer by means of suitable acoustic resistors of filters consisting of apertures which connect a space on the side of the magnets facing away from the diaphragm with the space between the diaphragm and the magnets. These apertures are filled with a suitably porous filter material. If this filter material were to be avoided the apertures would have to be made so small that it would be an extremely difficult process in terms of manufacturing.

In DE-AS No. 2.206.093 and DE-OS No. 2.322.475 there are provided an annular slit of a small cross sectional area corresponding to said acoustic resistors. Precisely the constituent parts' precise mutual centering allows the projections of the casing to be fitted in the hole of the carrier ring to thereby make the cross sectional aream of the slit sufficiently small. Elevations serve to additionally center the projection in the hole.

It is, however, proven that for acoustic resistor apertures in the form of annular or otherwise shaped slits the tolerance of the equivalent self-induction is undesirably high. The ideal crossection of the apertures is a circular hole and since sufficiently small holes are extremely difficult to make, these aperture resistors are in accordance with a feature of this invention simulated by pin shaped projection being integral part(s) of the casing unit and having substantially circular crossection, which are adapted to be closely fitted (inscribed) within a corresponding number of square crossectional holes in the carrier ring.

Figure 1A:
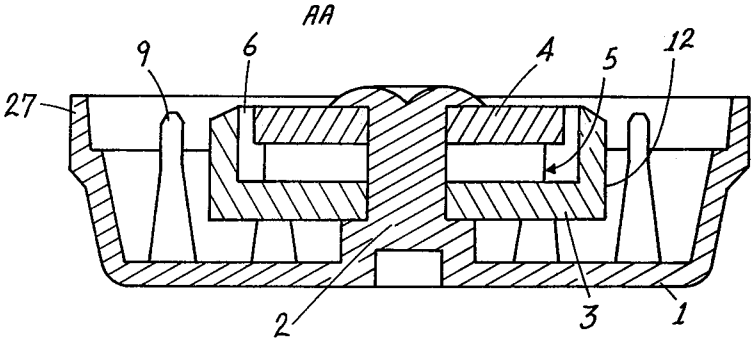
Figure 1:
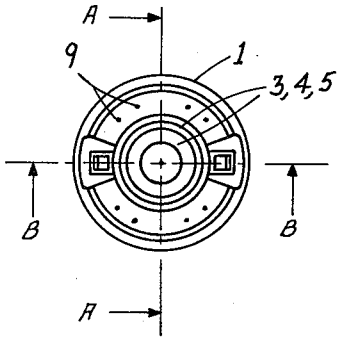
Figure 2B:
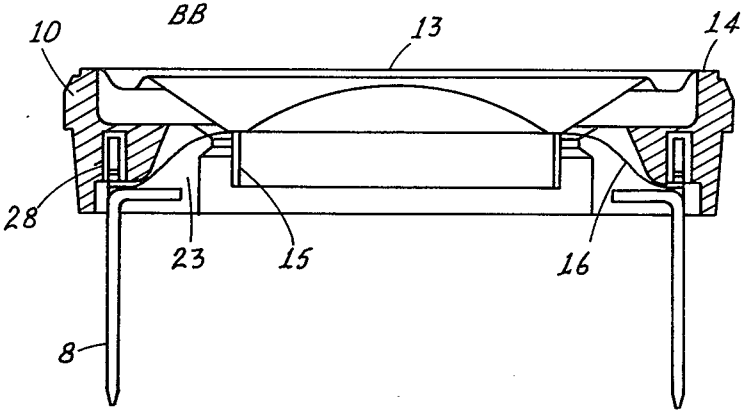
Figure 2A:
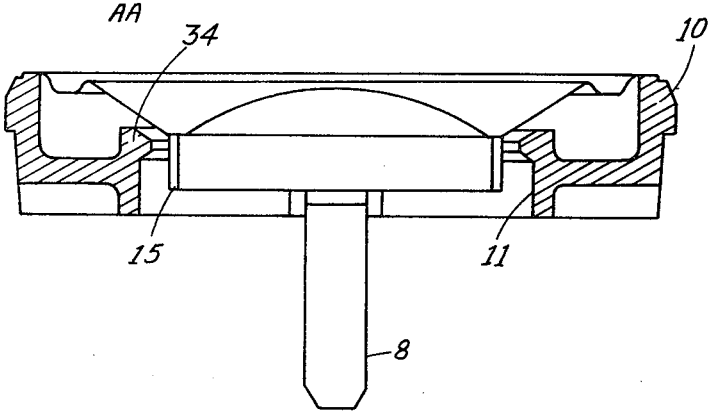
Figure 2:
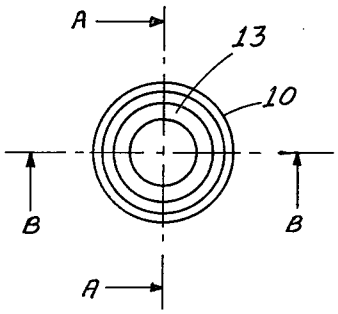
Figures 3, 3A, 3B, 3C:
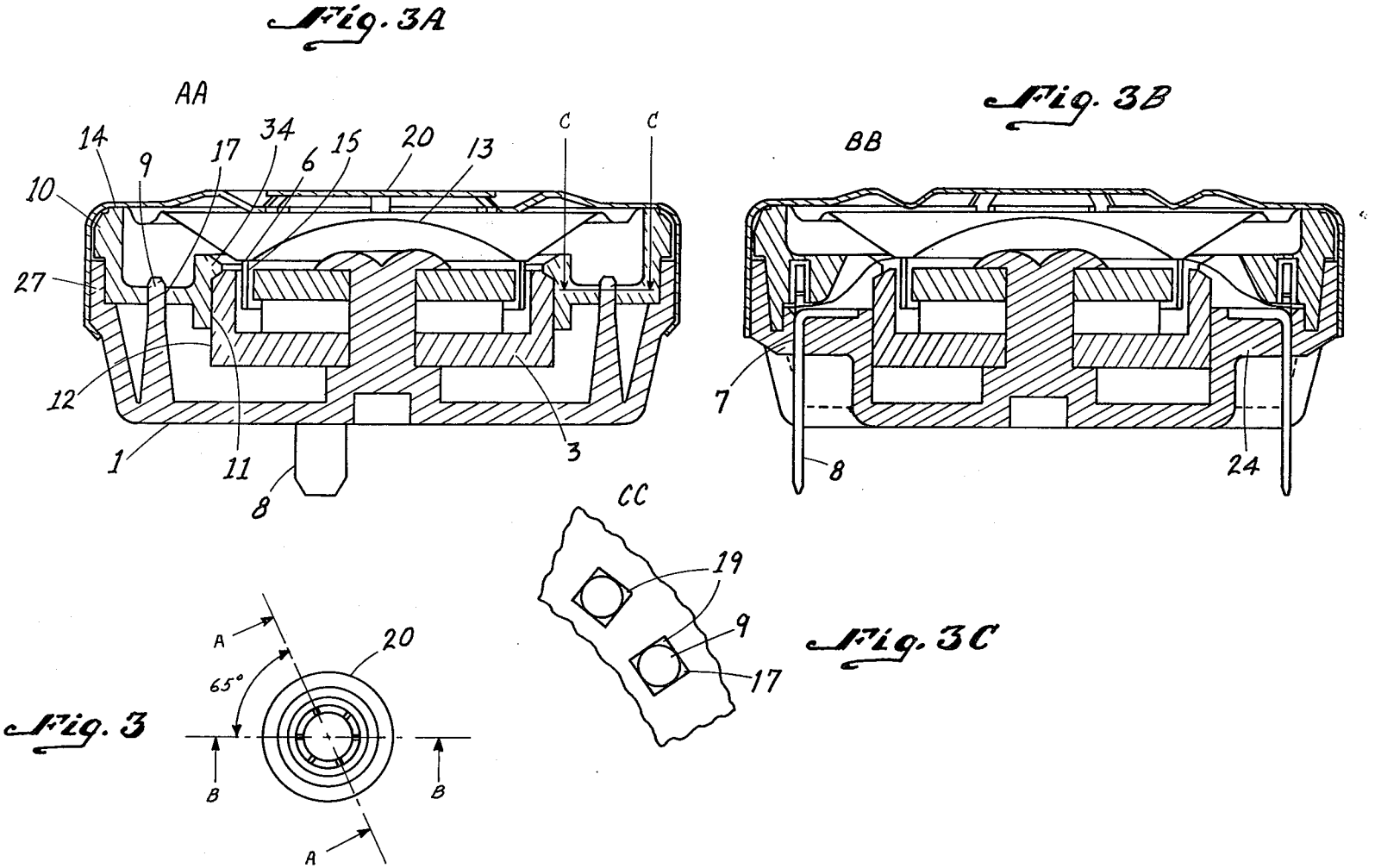
Figure 4B:
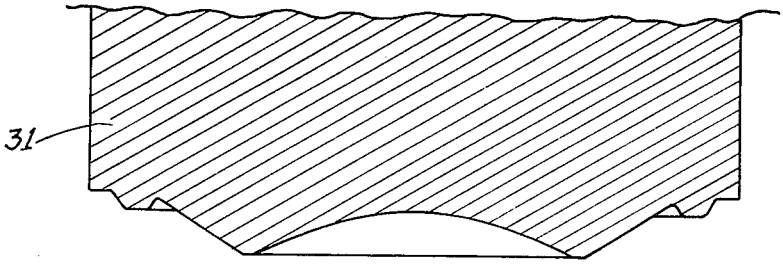
Figure 4C:
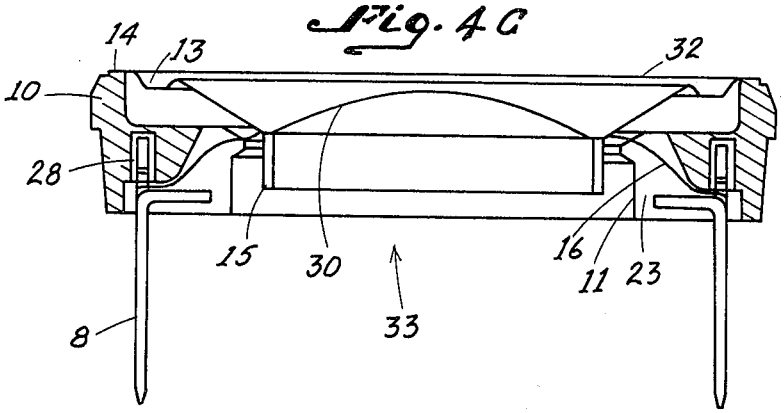
Figure 4A:
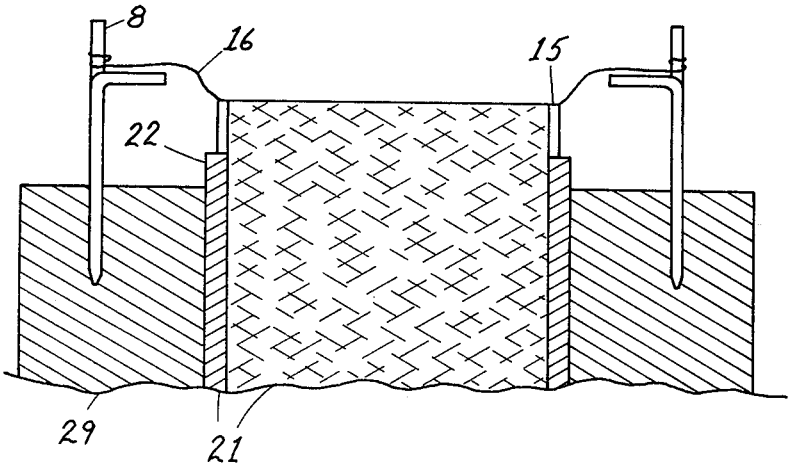

Above mentioned and other features and objects of the present invention will be clearly understood from the following detailed description of an embodiment of an electrodynamic transducer made in accordance with the process, taken in conjunction with the drawings, where:

FIGS. 1, 1A and 1B show the assembly of the magnet part of the transducer, FIGS. 2, 2A and 2B show the assembly of the coil-diaphragm part of the transducer, FIGS. 3, 3A and 3B show the assembly of the transducer constituted by the two parts shown in FIGS. 1 and 2, while FIG. 3*c* shows an enlarged view of a cut C—C of FIG. 3A, and FIGS. 4A and 4B show machine tools used to perform the method according to the present invention, while FIG. 4C is a repeat of FIG. 2B which is included for more clearly illustrating the invention.

In FIG. 1 is schematically shown the magnet part of the transducer, while FIG. 1A shows a cut through the line A—A and FIG. 1B shows a cut through the line B—B of FIG. 1. The magnetic part is shown essentially consisting of a casing part 1 with a pole shoe/magnet unit 3, 4 and 5.

FIGS. 1A and 1B show in more detail the casing part 1 with a guide pin 2 in the middle. The guide pin 2 carries an outer pole shoe 3 and an inner pole shoe 4 with holes for the guide pin. A permanent magnet 5 of high remanence, e.g. a ReCo-magnet, is interposed between the pole shoes 3 and 4. A narrow annular slit 6 is provided between the pole shoes 3 and 4 which for clarity is shown excessively wide. The slit 6 may be made very uniformly narrow along the entire periphery because the pole shoes 3 and 4 can be mounted very concentrically on the guide pin 2. The casing part 1 has two apertures 7 for opposite coil terminals 8, which are shown in the other figures. The outer pole shoe 3 is further stabilized by letting its outer cylindrical face 12 rest against inwardly facing cylindrical portions 26 of the casing 1. The casing 1 has also projections 9 forming part of acoustic resistors. The pole shoes 3 and 4 as well as the interposed magnet 5 may be axially retained on the guide pin 2 by a deformation of the outer end 18 of the guide pin. The casing 1 is also provided with an outer portion 27, the inner face of which is adapted to receive the carrier ring 10 (FIG. 2).

In FIG. 2 is schematically shown the coil-diaphragm part of the transducer, while FIG. 2A shows a cut through the line A—A of FIG. 2B shows a cut through the line B—B of FIG. 2. The coil-diaphragm part is shown essentially consisting of a carrier ring 10 to which is fixed a diaphragm 13 with a coil 15 connected to terminals 8.

FIGS. 2A and 2B show in more detail the carrier ring 10 having an inwardly facing, cylindrical face 11 of the same diameter as the outwardly facing, cylindrical face 12 (FIG. 1) of the outer pole shoe 3. A diaphragm 13 is circumferentially secured or fixed, e.g. by ultra sound welding, glutination, or the like to one side 14 of the carrier ring 10 so that said coil is exactly coaxial with the annular face 11 The two end leads or supply lines 16 of the coil are, as shown, connected through grooves 23 in the carrier ring 10 to coil terminals 8 which are secured in apertures 28 provided in the carrier ring 10. The coil 15 has the same diameter as the annular slit 6 (FIG. 1), but its thickness is of course smaller so as to allow the axial movement of the coil relatively to the slit. The carrier ring 10 has also holes 17 (shown in FIG. 3 only) extending within the periphery of the attachment face of the diaphragm 13 to the carrier ring 10 and connecting the diaphragm side 14 of the carrier ring 10 to its side facing away from the diaphragm. Furthermore the carrier ring 10 is provided with an inwardly protruding part 34 to be described in connection with FIG. 3.

In FIG. 3 is schematically shown the complete assembly of the transducer from the two parts shown respectively in FIGS. 1 and 2 and including a retaining ring 20, while FIG. 3A shows a cut through the line A—A and FIG. 3B shows a cut through the line B—B of FIG. 3.

FIG. 3A and FIG. 3B show in more detail the assembled state of the electrodynamic transducer parts shown in FIGS. 1 and 2, the terminals 8 fitting in the apertures 7 of the casing part 1. The inwardly facing, cylindrical face 11 of the carrier ring 10 engages the outwardly facing, cylindrical face 12 of the outer pole shoe 3 to thereby center the coil 15 exactly in the narrow, annular slit 6 between the two pole shoes 3 and 4. Additionally, the projections 9 are centered exactly in the holes 17 so as to form very narrow, holes 19 constituting an acoustic resistor or filter. This is shown in more detail in FIG. 3C. Finally, most of the transducer is encased by a retaining ring 20 serving the protect the diaphragm 13 and to keep the two parts together, and a somewhat resilient portion 27 of the casing part 1 engages the carrier ring 10. The carrier ring 10 is also provided with an inwardly protruding part 34 which locks against the outer pole shoe 3 so as to limit and define the axial position on the two parts (the magnet part and the coil diaphragm part) relatively to each other.

As illustrated in FIG. 3C which is an enlarged view of a cut C—C of FIG. 3A, the protruding pins 9 which are part of the casing 1 have a substantially circular crossection, the lower portion of the pins being cone shaped for stabilization purposes. Whereas it is previously known to use such cylindrical projections or pins 9 as part of a filter or acoustic resistor, the pins are as shown inserted into holes 17 of square crossection in order to obtain holes 19 which simulate small cylindrical holes which have very well defined self-induction. This construction easily lends itseof to reproducibility in automatic production lines. An alternative construction is to have a square crossectional pin inserted into a circular hole, but the holes left will then be more in the form of longitudinal slits than circular holes. Another alternative is to have a circular pin inserted into a triangular hole, but the circular pin/square hole construction is preferred.

In FIGS. 4A and 4B are shown machine tools used to perform the method of making the coil-diaphragm part of the transducer. This part is illustrated in FIG. 2B and it is repeated in FIG. 4C for more clearly illustrating how the tools are used.

In a first station a heat deformable planar sheet of diaphragm material is adhered, welded or by other means fixed to one side 14 of the carrier ring 10. It should be noted that the diaphragm 13 at this state is not in any way shaped into the form illustrated.

The separately made coil 15 is mounted on a guide templet 21 shown in FIG. 4A, a displaceable part 29 of which keeps the coil terminals 8 in a desired position, first when wrapping or connecting the coil leads 16 to the terminals 8, thereupon at the elevated position (or rather—lowered position) when dip soldering these connections, and finally in a third station to be described, to be at the correct level for insertion into the apertures 28 of the carrier ring 10. The guide templet 21 has an cylindrical engagement face 22 of the same outside diameter as the outer pole shoe 3.

In a second station, the side 30 of the still planar sheet facing towards the carrier ring 10 is provided with a heat activatable glue in an annular region which is coaxial with the carrier ring 10 and has the same diameter as the cylindrical slit 6 (FIGS. 1 and 3) between the two pole shoes 3 and 4. This can be done e.g. by dipping a ring (not shown) which is guided coaxially with respect to the cylindrical face 11 of the carrier ring 10, in a glue containing liquid and then causing it to contact the still plane diaphragm material.

In a third station, a heat emitting diaphragm forming tool 31, FIG. 4B, having a shape corresponding to the shape of the finished diaphragm 13 is directed coaxially towards the diaphragm side 32 facing away from the carrier ring 10, and at the same time the diaphragm sheet is subjected to pressurized air from the other side, as indicated by the arrow 33, which presses the diaphragm sheet into engagement with the forming tool, and the coil 15 fitted on the templet 21 is pressed against the heat activatable glue, the coil being guided by the cooperation of the engagement face 22 with the cylindrical face 11. Thus, heat from the tool 31 with which the diaphragm is softened and formed simultaneously activates the glue which attaches the coil 15 to the diaphragm 13. Simultaneously the terminals 8 are pressed into a fixed position in the apertures 28 in the carrier ring 10.

As shown, the carrier ring 10 has a groove 23 in which the coils leads 16 are placed. The casing part 1 (FIGS. 1 and 3) has projection 24 which mates with the grooves 23 and when the parts are joined, said projection closes the groove 23 on the outside of the coil leads 16 without clamping them.

Of course, the heat activatable glue may alternatively be applied to the coil 15 while it is present on the templet 21, but it has been found most expident to apply glue to the diaphragm 13.

I claim:

1. A method of making an electrodynamic transducer having a diaphragm connected to a coil which is axially movable in an annular slit between inner and outer pole shoes connected to respective poles of a magnet, and where the transducer is made from a magnet part and a separate coil/diaphragm part, the magnet part being made an integral part of a casing unit that includes a guide pin by attaching a pole shoe/magnet unit to the guide pin, comprising the steps of fixing in a first station a heat deformable, planar diaphragm material to one side of a carrier ring which has an inwardly facing, cylindrical face having the same diameter as an outwardly facing, cylindrical face of the outer pole shoe such that one major surface of the diaphragm material faces the carrier rings, applying in a second station a heat activitable glue capable of bonding the coil to the diaphragm material to one of said one major surface and said coil at a region which is coaxial with the carrier ring and has the same diameter at the annular slit between the pole shoes, applying a third station a heat emitting diaphragm forming tool coaxially to a side of the diaphragm material facing away from the carrier ring, simultaneously pressing the diaphragm material into engagement with the forming tool by directing pressurized air against the opposite side of the diaphragm material to form the diaphragm therefrom, and pressing the coil against said region while said coil is supported on a guide templet which has an annular engagement face of the same outer diameter as the outer pole shoe.

2. A method according to claim 1 for use in a transducer where the two parts of the transducer when assembled provide for a predetermined number of integral acoustic resistors in the form of pins inserted into holes, further comprising the steps of forming pin shaped projections having substantially circular cross sections as integral parts of the casing unit, and providing a corresponding number of square cross sectional holes in the carrier ring, and introducing said projections into said holes during the assembly of the two parts to be fittingly received in the latter.

* * * * *